US009709275B2

(12) United States Patent
de Diego et al.

(10) Patent No.: US 9,709,275 B2
(45) Date of Patent: Jul. 18, 2017

(54) DEBRIS REMOVAL SYSTEM

(71) Applicant: General Electric Company, Schenectady, NY (US)

(72) Inventors: Peter de Diego, Saluda, NC (US); Herbert Chidsey Roberts, III, Simpsonville, SC (US); Frederic Woodrow Roberts, Jr., Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 339 days.

(21) Appl. No.: 14/314,075

(22) Filed: Jun. 25, 2014

(65) Prior Publication Data

US 2015/0377074 A1 Dec. 31, 2015

(51) Int. Cl.
*F23R 3/02* (2006.01)
*F23R 3/00* (2006.01)

(52) U.S. Cl.
CPC ..... *F23R 3/02* (2013.01); *F23R 3/002* (2013.01); *F05D 2250/181* (2013.01); *F05D 2250/182* (2013.01); *F05D 2250/183* (2013.01); *F05D 2250/184* (2013.01); *F05D 2260/607* (2013.01)

(58) Field of Classification Search
CPC ..... F05D 2260/607; F02C 7/05; F02C 7/052; F02C 7/055; F23R 3/04; F04D 29/54; F04D 29/545; B64D 2033/022; F05B 2260/63
See application file for complete search history.

(56) References Cited

U.S. PATENT DOCUMENTS 4,928,480 A * 5/1990 Oliver ..... B64D 33/02 55/306
5,152,134 A 10/1992 Boyd et al.
7,581,397 B2 * 9/2009 Strangman ..... F04D 29/441 415/121.2
2013/0160411 A1 * 6/2013 Mayer ..... F02C 7/052 55/418

FOREIGN PATENT DOCUMENTS

| | | |
|---|---|---|
| EP | 0246039 | 11/1987 |
| EP | 0304762 | 3/1989 |
| EP | 0965728 | 4/2004 |
| WO | WO 96/36799 | 11/1996 |

OTHER PUBLICATIONS

Butterfly Effect News Article published in The Columbus Dispatch, on Feb. 27, 2014.

* cited by examiner

*Primary Examiner* — Pascal M Bui Pho
*Assistant Examiner* — Stefan Ibroni
(74) *Attorney, Agent, or Firm* — Dority & Manning, P.A.

(57) ABSTRACT

A casing for a turbo-machine at least partially defines a flow path for a working fluid through or around one or more of a compressor section, a combustor assembly, or a turbine section. The casing defines an inner surface and the inner surface defines a plurality of debris routing channels. The plurality of debris routing channels are configured to route debris in a working fluid within the casing towards a debris collection mechanism.

16 Claims, 4 Drawing Sheets

DEBRIS REMOVAL SYSTEM

FIELD OF THE INVENTION

The present disclosure generally relates to a turbo-machine having one or more features for the removal of debris from the working fluid.

BACKGROUND OF THE INVENTION

Turbo-machines are widely used in industrial and commercial operations, and generally include a compressor, a combustion assembly, and a turbine. A working fluid, such as air, may be brought in to the compressor, compressed, and directed to the combustion assembly as a pressurized working fluid. At least a portion of the pressurized working fluid is mixed with a fuel and burned in the combustion assembly to generate hot combustion gasses. The hot combustion gasses are directed to the turbine of the turbo-machine, where energy is extracted from the hot combustion gasses.

The performance of a turbo-machine depends in part on a temperature that may be sustained during operation of the turbo-machine without damaging components such as the blades in the turbine or certain combustor components in the combustion assembly. Certain of these components may be formed of various metal alloys designed to withstand heightened temperatures. However, the maximum sustainable temperature of the components is still far below the temperature associated with a stoichiometric combustion process.

In certain turbo-machines, the maximum sustainable temperature of certain components is increased by allocating a portion of the compressed working fluid from the compressor for cooling such components. For example, compressed working fluid may be diverted around one or more combustors of the combustor assembly and/or may be diverted through cooling passages in the turbine. The cooling passages may carry the relatively cool compressed working fluid through the turbine blades to maintain the blades within an acceptable operating temperature range.

However, certain issues may arise with such a construction. For example, the working fluid may contain debris, such as foreign particles originating outside the turbo-machine, or domestic particles—including rust, dirt, and/or dust—originating within the turbo-machine. The particles may get caught the cooling passages and block airflow to, for example, the turbine blades. Blocked airflow in the cooling passages may lead to damage of certain components or unplanned outages to unclog and clean the cooling passages. Prior turbo-machines have included various air filtration methods to filter the working fluid prior to it entering the compressor of the turbo-machine. Additionally, dehumidification methods may also be employed when the turbo-machine is not operating to minimize an amount of rust generated within the turbo-machine.

However, the known methods may not capture all foreign particles in the working fluid, or prevent all domestic particles from entering the working fluid. Accordingly, a system for reducing the amount of foreign or domestic particles in the working fluid of the turbo-machine would beneficial. More particularly, a system for capturing foreign and/or domestic particles in the working fluid would be particularly useful.

BRIEF DESCRIPTION OF THE INVENTION

Aspects and advantages of the invention are set forth below in the following description, or may be obvious from the description, or may be learned through practice of the invention.

In one exemplary embodiment, a turbo-machine is provided including a compressor section, a combustor assembly in communication with the compressor section, and a turbine section in communication with the combustor assembly. The turbo-machine additionally includes a casing at least partially defining a flow path for a working fluid through or around one or more of the compressor section, the combustor assembly, and the turbine section. The casing defines an inner surface in contact with the working fluid, the inner surface defining a plurality of debris routing channels. Moreover, the turbo-machine includes a debris collection mechanism. The plurality of debris routing channels extending generally towards the debris collection mechanism, such that the debris routing channels route debris towards the debris collection mechanism during operation of the turbo-machine.

In another exemplary embodiment, a debris removal system for a turbo-machine is provided, the turbo-machine including a compressor section, a combustor assembly, and a turbine section. The debris removal system includes a casing at least partially defining a flow path for a working fluid through or around one or more of the compressor section, the combustor assembly, and the turbine section of the turbo-machine. Also, the casing defines an inner surface in contact with the working fluid, the inner surface defining a plurality of debris routing channels. Moreover, the debris collecting system includes a debris collection mechanism, the debris routing channels extending generally towards the debris collection mechanism, such that the debris routing channels route debris towards the debris collection mechanism during operation of the turbo-machine.

These and other features, aspects and advantages of the present disclosure will become better understood with reference to the following description and appended claims. The accompanying drawings, which are incorporated in and constitute a part of this specification, illustrate embodiments of the disclosure and, together with the description, serve to explain the principles of the disclosure.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
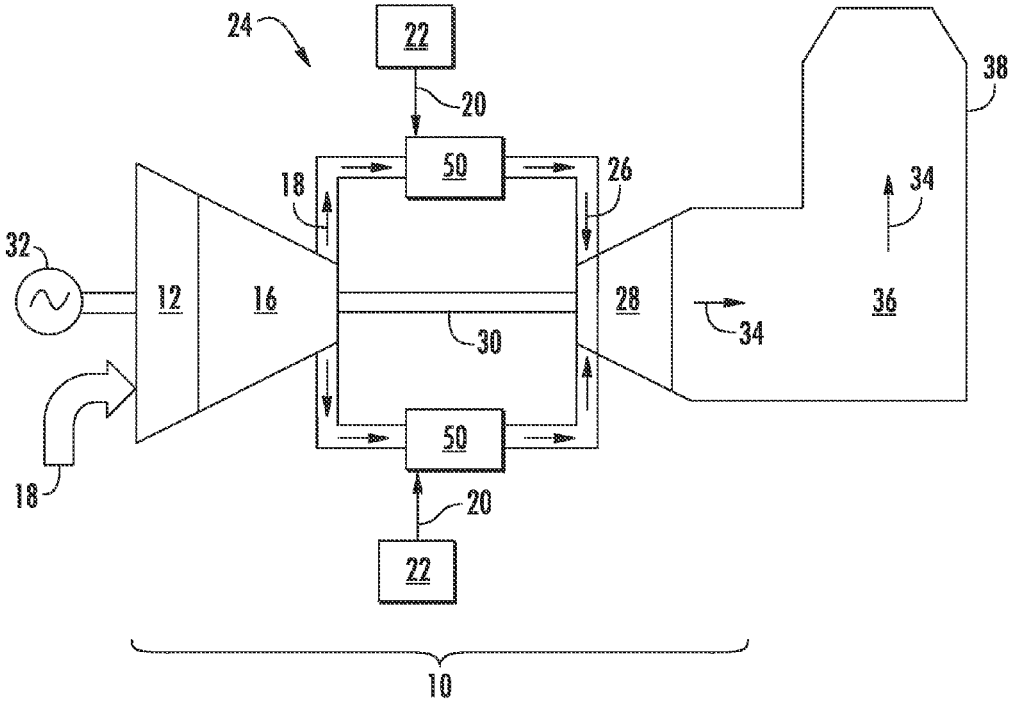
FIG. 1 is a functional block diagram of an exemplary turbo-machine in accordance with an exemplary embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "upstream" and "downstream" refer to the relative direction with respect to fluid flow in a fluid pathway. For example, "upstream" refers to the direction from which the fluid flows, and "downstream" refers to the direction to which the fluid flows.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Although exemplary embodiments of the present invention will be described generally in the context of a turbo-machine for power generation for purposes of illustration, one of ordinary skill in the art will readily appreciate that embodiments of the present invention may be applied to any turbo-machine, such as a turbo-machine used in an aviation field.

Certain exemplary embodiments of the present disclosure include a casing for a turbo-machine at least partially defining a flow path for a working fluid through or around of one or more of a compressor section, a combustor assembly, or a turbine section. The casing defines an inner surface, and the inner surface defines a plurality of debris routing channels. The plurality of debris routing channels are configured to route debris in a working fluid within the casing towards a debris collection mechanism.

Referring now to the drawings, wherein identical numerals indicate the same elements throughout the figures, FIG. 1 provides a functional block diagram of an exemplary turbo-machine 10 that may incorporate various embodiments of the present invention. As shown, the turbo-machine 10 generally includes an inlet section 12 that may include a series of filters, cooling coils, moisture separators, and/or other devices to purify and otherwise condition a working fluid (e.g., air) 18 entering the turbo-machine 10. The working fluid 18 flows to a compressor section 16 where a compressor progressively imparts kinetic energy to the working fluid 18 to compress the working fluid 18 to a highly energized state.

The compressed working fluid 18 flows from the compressor section 16 and is mixed with a fuel 20 from a fuel supply 22 to form a combustible mixture within one or more combustors 50 within a combustor assembly 24. The combustible mixture is burned to produce combustion gases 26 having a high temperature and pressure. The combustion gases 26 flow through a turbine of a turbine section 28 to produce work. The turbine in the turbine section 28 may be connected to a shaft 30 so that rotation of the turbine drives the compressor to produce the compressed working fluid 18. Alternatively, or additionally, the shaft 30 may connect the turbine to a generator 32 for producing electricity. Exhaust gases 34 from the turbine section 28 flow through an exhaust section 36 that connects the turbine section 28 to a downstream exhaust stack 38. The exhaust section 36 may include, for example, a heat recovery steam generator (not shown) for cleaning and extracting additional heat from the exhaust gases 34 prior to release to the environment.

Figure 2:
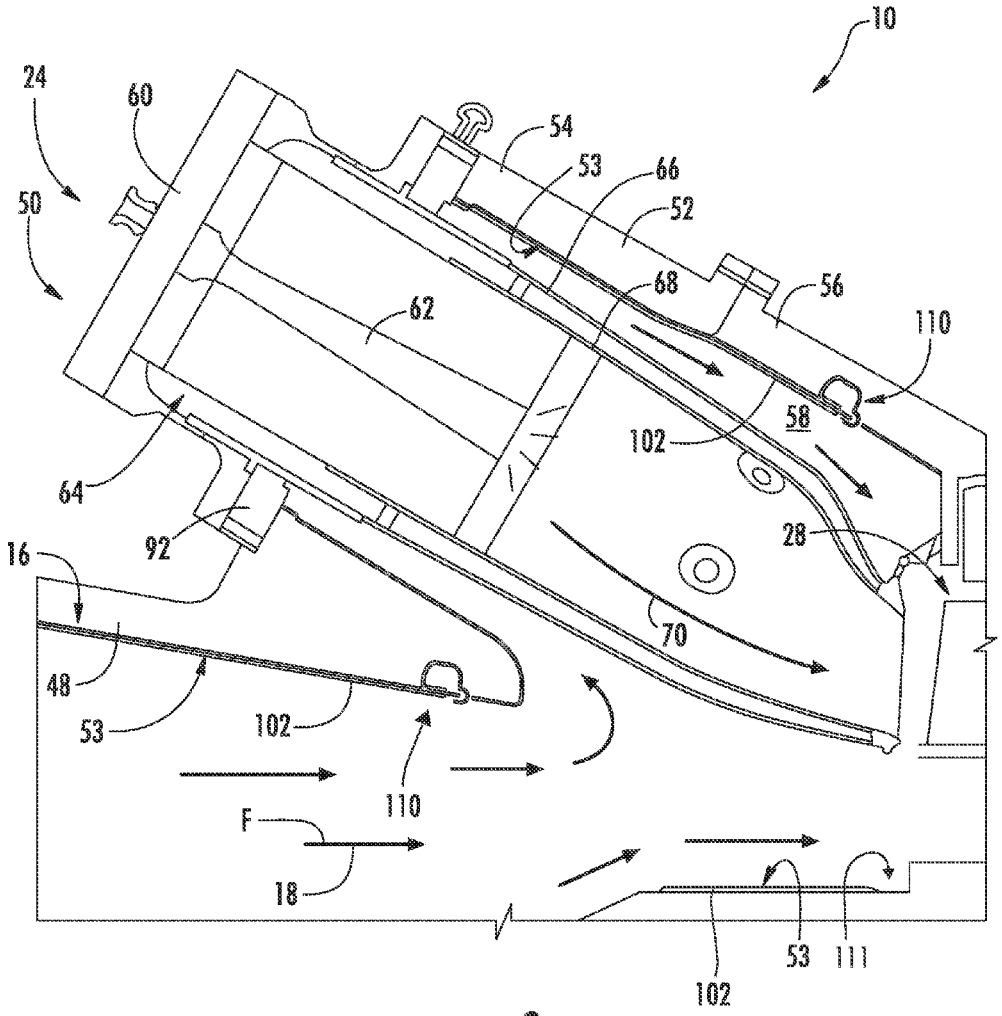
FIG. 2 is a cross-sectional side view of a portion of an exemplary turbo-machine including an exemplary system for collecting debris in the working fluid.

Referring now to FIG. 2, a cross-sectional side view of a portion of an exemplary turbo-machine 10 is provided. As shown, the turbo-machine 10 generally includes a casing 52 surrounding at least a portion of the compressor section 16, the combustor assembly 24, and the turbine section 28. More particularly, the casing 52 at least partially defines a flow path for the working fluid 18 through and/or around one or more of the compressor section 16, the combustor assembly 24, and the turbine section 28. For example, as depicted in FIG. 2, the casing 52 comprises a compressor casing 48, a compressor discharge casing 54, and a turbine casing 56. Moreover, as depicted, the outer casing 52 defines an inner surface 53 in contact with the working fluid 18.

For the exemplary turbo-machine 10 of FIG. 2, the combustor 50 is at least partially surrounded by the compressor discharge casing 54 and positioned downstream from the compressor section 16 and upstream from the turbine section 28. The compressor discharge casing 54 is attached to the turbine casing 56 to define a high pressure plenum 58 comprised of the compressed working fluid 18 flowing from the compressor section 16 around the combustor 50. An end cover 60 is provided, coupled to the casing 52 at one end of the combustor 50 to assist in mounting the combustor 50 to the casing 52.

As shown in FIG. 2, the combustor 50 generally includes at least one axially extending fuel nozzle 62 extending downstream from the end cover 60, an annular cap assembly 64 positioned downstream from the end cover 60, an annular hot gas path duct or combustion liner 66 that extends downstream from the cap assembly 64, and an annular flow sleeve 68 that surrounds at least a portion of the combustion liner 66. The combustion liner 66 defines a hot gas path 70 for routing the combustion gases 26 (see FIG. 1) through the combustor 50 and into the turbine section 28. The exemplary combustor assembly 24 of FIG. 2 is generally referred to as a cannnular combustor assembly.

It should be appreciated, however, that the combustor 50 and the combustor assembly 24 depicted in FIG. 2 are provided by way of example only, and in other exemplary embodiments of the present disclosure the turbo-machine 10 may include any other combustor 50 and/or combustor assembly 24 configuration. For example, in other exemplary embodiments, the combustor assembly 24 may not be a cannular combustion assembly, and instead may be what is commonly referred to as a can combustor assembly, or alternatively may be what is commonly referred to as an annular combustor assembly. Additionally, in other exemplary embodiments, for example, the combustion liner 66 and flow sleeve 68 may not be single units, and instead may be comprised of two or more portions joined together in any suitable manner. Moreover, in still other exemplary embodiments, the casing 52 may include additional portions not depicted in the Figs., or alternatively the casing 52 may integrate two or more of the casings depicted in the FIG. 2.

With continued reference to FIG. 2, the exemplary turbo-machine 10 further includes a system for collecting debris in the working fluid 18 flowing through and/or around various components of the turbo-machine 10 within the outer casing 52. More particularly, as will be described in greater detail below, the inner surface 53 of the outer casing 52 defines a plurality of debris routing channels 102 configured to route debris from the working fluid 18 generally towards a debris collection mechanism. The debris collection mechanism may receive and collect the debris from the working fluid 18. For the exemplary turbo-machine 10 of FIG. 2, certain of the debris collection mechanisms are configured as a debris trap 110 made integrally with the casing 52, while another debris collection mechanism is an area 111 within the casing 52 of the turbo-machine 10 where the working fluid 18 flows therethrough at a relatively low velocity, such that any debris collected would be less likely to be carried away by the working fluid 18.

It should be understood, however, that in other exemplary embodiments, the turbo-machine 10 may include any suitable number of debris collection mechanism(s) positioned in any suitable location within the turbo-machine 10. Additionally, as will be explained below, in other exemplary embodiments, the debris collection mechanism(s) may have any suitable shape, size, or configuration for receiving and collecting debris from the working fluid.

Figure 3:
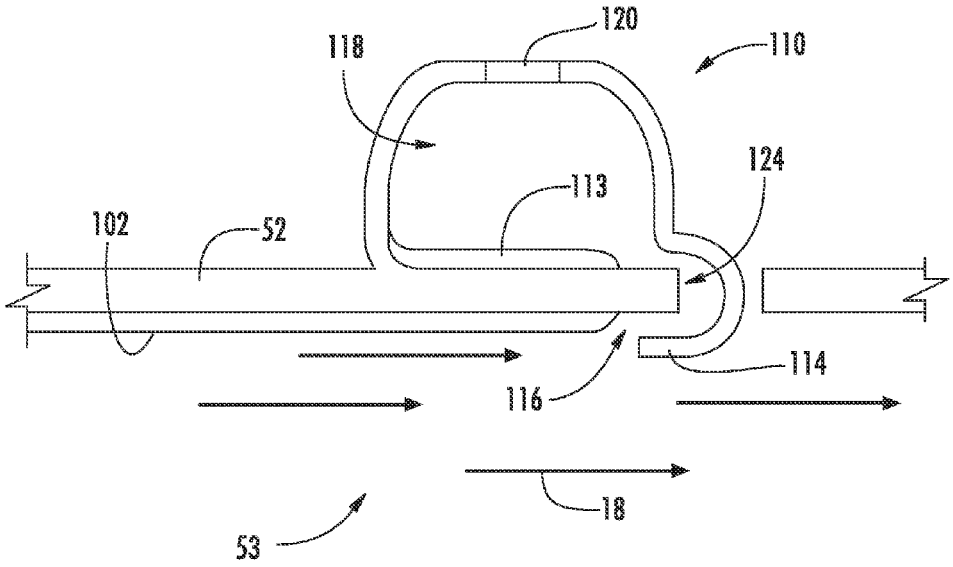
FIG. 3 is an exemplary debris trap in accordance with an exemplary embodiment of the present invention.

Referring now to FIG. 3, a cross-sectional side view of an exemplary debris trap 110 is provided. As shown, the exemplary debris trap 110 includes a gap 116 defined by the outer casing 52 and a lip 114 of the debris trap 110—the gap 116 configured to receive debris routed thereto from the channels 102. The lip 114 additionally defines a channel 124 with the casing 52 leading to a cavity 118 for the receipt and storage of any debris removed from the working fluid 18. Accordingly, the cavity 118 is fluidly connected to the gap 116 via the channel 124. For the embodiment depicted, the debris trap 110 further includes a flange 113 positioned in the cavity 118 and on a back side of the flow path. The flange 113 may assist in attaching the debris trap 110 to the casing 52 without interfering with the flow of working fluid 18 therethrough.

In certain embodiments, the casing 52 may define an annular shape with respect to an axial direction of the turbo-machine 10, such that the casing 52 surrounds one or more sections of the turbo-machine 10. In such an embodiment, the debris trap 110, including the cavity 118, may additionally define an annular shape, extending inwardly along an entire inner circumference of the inner surface 53 of the casing 52.

With continued reference to the exemplary embodiment of FIG. 3, the cavity 118 of the debris trap 110 includes a chute 120 for emptying the debris contained in the cavity 118. The chute 120 may be a hinged door configured to open inwardly towards the cavity 118 to allow for emptying of debris positioned therein. The chute 120 may be accessed during, for example, planned outage or maintenance times of the turbo-machine 10 and emptied using a vacuum and/or compressed air collection system (not shown). When the debris trap 110 defines a continuous annular shape extending inwardly from the inner surface 53 of the casing 52, the chute 120 may include a plurality of chutes spaced along the cavity 118 in any suitable manner.

Additionally, in another exemplary embodiment, the debris trap 110 may further include additional structures attached to, for example, the chute 120 for automatically emptying the cavity 118. In such an embodiment, emptying may be initiated in response to a debris level of the cavity 118 sensed by a senor positioned therein, or alternatively may be emptied at fixed time intervals.

The debris trap of FIG. 3 is made integrally with the outer casing 52. It should be appreciated, however, that in other exemplary embodiments, the debris trap 110 may be separate from the casing 52 and attached to the casing 52 in any suitable manner. For example, in certain exemplary embodiments, the debris trap 110 may be attached solely using the flange 113, the flange 113 bolted on, or welded to the casing 52. Additionally, it should be appreciated that in other exemplary embodiments, the lip 114 of the trap 110 may be attached at a rear side directly to the casing 52, such that the only opening in the casing 52 proximate to the trap 110 is the gap 116 and channel 124.

Referring now to FIGS. 4 through 8, overhead views of portions of various exemplary inner surfaces 53 of the casing 52 of the turbo-machine 10 are provided, each defining a plurality of debris routing channels 102. The exemplary debris routing channels 102 depicted in FIGS. 4 through 8 each extend generally along a flow direction F of the working fluid 18 towards a debris collection mechanism (FIG. 2).

Figure 4:
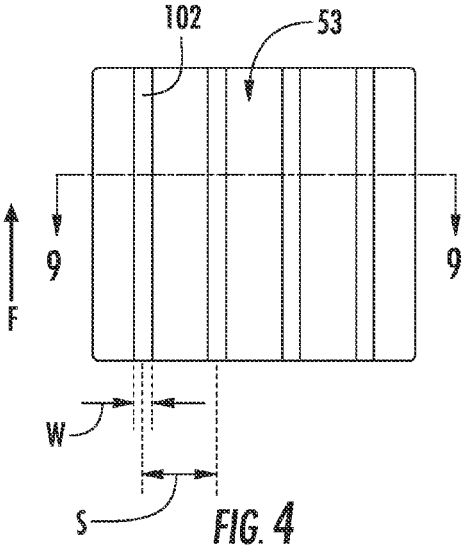
FIG. 4 is an overhead view of an exemplary inner surface of a casing of the turbo-machine defining a plurality of debris routing channels.
Figure 5:
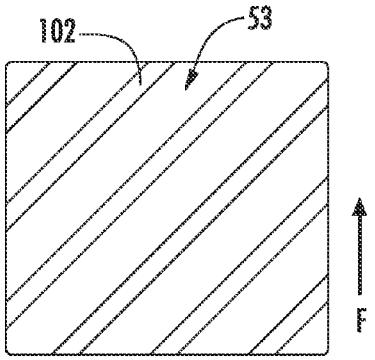
FIG. 5 is an overhead view of another exemplary inner surface of a casing of the turbo-machine defining a plurality of debris routing channels.
Figure 6:
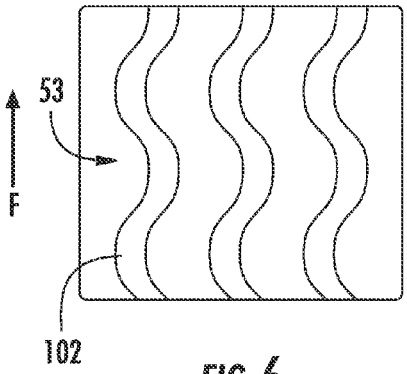
FIG. 6 is an overhead view of still another exemplary inner surface of a casing of the turbo-machine defining a plurality of debris routing channels.
Figure 7:
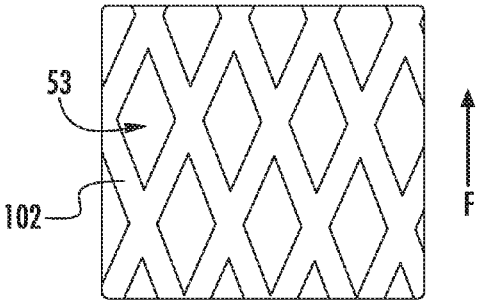
FIG. 7 is an overhead view of yet another exemplary inner surface of a casing of the turbo-machine defining a plurality of debris routing channels.
Figure 8:
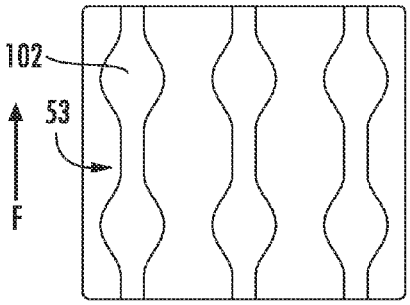
FIG. 8 is an overhead view of still another exemplary inner surface of a casing of the turbo-machine defining a plurality of debris routing channels.

With reference to FIG. 4, a first embodiment is provided, wherein the plurality of channels 102 define a plurality of parallel channels, each extending in a direction generally parallel to the flow direction F of the working fluid 18. Additionally, each channel in the plurality of channels 102 defines a width W and a separation distance S, measured from a center of one channel to a center of an adjacent channel. In certain exemplary embodiments, the width W of the channels 102 may be less than or equal to about 1 inch, such as less than or equal to about 0.5 inches, such as less than or equal to about 0.25 inches, such as less than or equal to about 0.125 inches, or even less. Alternatively, the width W of the channels 102 may in other exemplary embodiments be greater than about 1 inch. Furthermore, in still other exemplary embodiments, each channel in the plurality of channels 102 may have a different width W relative to an adjacent channel.

The separation S of the channels 102 depicted in FIG. 4 is greater than or equal to the width W of the channels 102. For example, the separation S of the channels 102 may be 5% greater, 10% greater, 50% greater, 75% greater, 100% greater, or more. Alternatively, in other exemplary embodiments, the separation S may vary between the channels 102.

Referring now to FIGS. 5 through 8, alternative embodiments are provided of the plurality of channels 102. In the exemplary embodiment of FIG. 5, the plurality of parallel channels 102 extend in a direction generally oblique to the flow direction F of the working fluid 18. Alternatively, in the exemplary embodiment of FIG. 6, the plurality of channels 102 include a plurality of nested wavy channels extending generally along the flow direction F of the working fluid 18. Further, in the exemplary embodiment of FIG. 7, the plurality of channels 102 define a crossing pattern, or a nested diamond-shaped pattern. Moreover, in the exemplary embodiment of FIG. 8, the plurality of channels 102 define an hourglass pattern.

It should be appreciated, however, that the embodiments of FIGS. 4 through 8 are provided by way of example only, and that in other exemplary embodiments, the plurality of debris routing channels 102 may have any other shape or configuration. For example, the plurality of channels 102 may alternatively define a herringbone pattern, or may extend in a direction approximately perpendicular to the flow direction F of the working fluid 18.

The plurality of channels 102 of FIGS. 4 through 8 may further include a coating (not shown) configured to assist in the collecting and routing of debris from the working fluid 18 towards a debris collection mechanism. The coating may be a waxy coating or any suitable corrosion or oxidation resistant coating. For example, in certain exemplary embodiments, the coating may be an aluminum-based corrosion and/or oxidation resistant coating, or alternatively may be a zinc-based corrosion and/or oxidation resistant coating.

Figure 9:
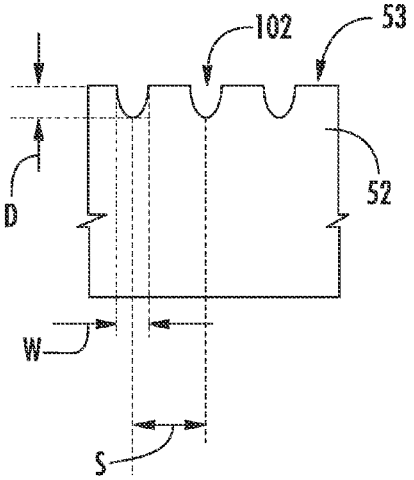
FIG. 9 is a cross-sectional view of an exemplary casing of the turbo-machine defining a plurality of debris routing channels.

With reference now to FIG. 9, a cross-sectional view is provided of the exemplary casing 52 of FIG. 4, viewed along Line 9 in FIG. 4. As shown, the exemplary debris routing channels 102 are a plurality of rounded channels 102. Each of the exemplary channels 102 additionally define a depth D. The depth D of each channel is approximately equal to the width W of the same channel. In alternative embodiments, however, the channels 102 may define a semi-circular cross section such that depth D is approximately half of the width W, or alternatively the depth D may be greater than the width W. Referring still to FIG. 9, the plurality of channels 102 defined by the inner surface 53 of the casing 52 are made integrally with the casing 52. For example, the channels 102 may be machined into the inner surface 53 of the casing 52, or alternatively, may be cast with the casing 52 during formation of the casing 52.

It should be appreciated, however, that in other exemplary embodiments, the plurality of grooves 102 may be defined by the inner surface 53 of the casing 52 in any other suitable manner. For example, the plurality of grooves 102 may be defined by the inner surface 53 by attaching a plurality of longitudinally extending strips to the inner surface 53, or alternatively by attaching a sheet to the inner surface of the casing, the sheet defining the plurality of grooves. In either of the above embodiments, the strips and/or sheet material may be attached to the casing 52 and become part of the casing 52 in any suitable manner. For example, the strips and/or sheet material may be welded to the casing 52 to form the inner surface 53 of the casing, or alternatively may be bolted on or otherwise affixed to the casing 52 using, for example, an epoxy or glue. Moreover, the strips and/or sheet material may be comprised of any material capable of withstanding the operating conditions of the section of the turbo-machine 10 adjacent to which it is positioned.

Furthermore, in still other exemplary embodiments of the present disclosure, the plurality of debris routing channels 102 defined by the inner surface 53 of the casing 52 may have any other suitable cross-sectional shape. For example, the plurality of grooves 102 may define a V-shaped cross-sectional shape.

The inclusion of the plurality of grooves 102 extending generally towards a debris collection mechanism, such as the debris trap 110 (see FIGS. 2 and 3) may remove a portion of any foreign or domestic particles from the working fluid 18 in the turbo-machine 10. Removal of certain foreign or domestic particles may prevent damage to certain components of the turbine during operation of the turbo-machine 10 by, for example, preventing cooling passages from becoming clogged with the particles. The cooling passages may extend through the various components of the turbine, such as the turbine blades, to maintain the components within a safe operating temperature. By preventing cooling passages from becoming clogged, cooling air (such as the working fluid 18) may more consistently reach certain components of the turbine. This may allow the cooling passages to better remove heat from the components and maintain the temperatures of the components within a safe operating temperature.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal language of the claims.

What is claimed:

1. A debris removal system for a turbo-machine, the turbo-machine comprising a compressor section, a combustor assembly, and a turbine section, the debris removal system comprising:

a casing at least partially defining a flow path for a working fluid through or around one or more of the compressor section, the combustor assembly, and the turbine section of the turbo-machine, the casing defining an inner surface in contact with the working fluid, the inner surface defining a plurality of debris routing channels, wherein the plurality of debris routing channels are disposed on the inner surface; and a debris collection mechanism downstream of the plurality of debris routing channels, the plurality of debris routing channels extending generally towards the debris collection mechanism, such that the plurality of debris routing channels route debris towards the debris collection mechanism during operation of the turbo-machine;

wherein the debris collection mechanism is a debris trap attached to or made integrally with the casing, the debris trap comprising a lip positioned at least partially in the flow path and defining a gap configured to receive debris from the plurality of debris routing channels, the gap defined directly between the lip of the debris trap and the inner surface of the casing;

wherein the debris trap further comprises a cavity in fluid communication with the gap for receipt and storage of the debris, the cavity located on an outer surface of the casing and upstream of the lip relative to the flow path for the working fluid.

2. The system of claim 1, wherein the plurality of debris routing channels extend in a direction generally parallel to a flow direction of the working fluid.

3. The system of claim 1, wherein the working fluid is compressed air from the compressor section of the turbo-machine.

4. The system of claim 1, wherein the casing surrounds at least a portion of a compressor section or a combustor assembly of the turbo-machine.

5. The system of claim 1, wherein the casing is a compressor discharge casing positioned around at least a portion of a combustor assembly of the turbo-machine.

6. The system of claim 1, further comprising a coating on the plurality of debris routing channels, the coating configured to assist in collecting and routing debris from the working fluid.

7. A turbo-machine comprising:

a compressor section;

a combustor assembly in communication with the compressor section;

a turbine section in communication with the combustor assembly;

a casing at least partially defining a flow path for a working fluid through or around one or more of the compressor section, the combustor assembly, and the turbine section, the casing defining an inner surface in contact with the working fluid, the inner surface defining a plurality of debris routing channels; and a debris collection mechanism downstream of the plurality of debris routing channels, the plurality of debris routing channels extending generally towards the debris collection mechanism, such that the plurality of debris routing channels route debris towards the debris collection mechanism during operation of the turbo-machine, wherein the plurality of debris routing channels are disposed on the inner surface;

wherein the debris collection mechanism is a debris trap attached to or made integrally with the casing, the debris trap comprising a lip positioned at least partially in the flow path and defining a gap configured to receive debris from the plurality of debris routing channels, the gap defined between the lip of the debris trap and the inner surface of the casing;

wherein the debris trap further comprises a cavity in fluid communication with the gap for receipt and storage of the debris, the cavity located on an outer surface of the casing and upstream of the lip relative to the flow path for the working fluid.

8. The turbo-machine of claim 7, wherein the plurality of debris routing channels extend in a direction generally parallel or oblique to a flow direction of the working fluid.

9. The turbo-machine of claim 7, wherein the casing surrounds at least a portion of the compressor section or the combustor assembly.

10. The turbo-machine of claim 7, wherein the casing is a compressor discharge casing positioned around at least a portion of the combustor assembly.

11. The turbo-machine of claim 7, wherein the plurality of debris routing channels each define a width of less than or equal to about one inch.

12. The turbo-machine of claim 7, wherein the plurality of debris routing channels define a pattern, the pattern comprising a plurality of parallel channels, nested wavy channels, nested diamond-shaped channels, or a combination thereof.

13. The turbo-machine of claim 7, wherein the working fluid is compressed air from the compressor section of the turbo-machine.

14. The turbo-machine of claim 7, wherein the debris trap further comprises a chute for emptying the debris contained in the cavity.

15. The turbo-machine of claim 7, further comprising a coating on the plurality of debris routing channels, the coating configured to assist in collecting and routing debris from the working fluid.

16. The turbo-machine of claim 15, wherein the coating comprises a zinc-based or aluminum-based corrosion or oxidation resistant coating.

* * * * *